US010923864B2

(12) United States Patent
Nass et al.

(10) Patent No.: US 10,923,864 B2
(45) Date of Patent: Feb. 16, 2021

(54) OVERVOLTAGE PROTECTION MODULE FOR A MODULAR PLUG CONNECTOR

(71) Applicant: HARTING Electric GmbH & Co. KG, Espelkamp (DE)

(72) Inventors: Andreas Nass, Warmsen (DE); Stefan Garske, Bad Essen (DE); Frank Quast, Bielefeld (DE)

(73) Assignee: HARTING ELECTRIC GMBH & CO. KG, Espelkamp (DE)

( * ) Notice: Subject to any disclaimer, the term of this patent is extended or adjusted under 35 U.S.C. 154(b) by 0 days.

(21) Appl. No.: 16/331,107

(22) PCT Filed: Aug. 31, 2017

(86) PCT No.: PCT/DE2017/100730
§ 371 (c)(1),
(2) Date: Mar. 6, 2019

(87) PCT Pub. No.: WO2018/046056
PCT Pub. Date: Mar. 15, 2018

(65) Prior Publication Data

US 2019/0237913 A1 Aug. 1, 2019

(30) Foreign Application Priority Data

Sep. 9, 2016 (DE) ..... 102016116926.9

(51) Int. Cl.
*H01R 13/66* (2006.01)
*H01R 13/506* (2006.01)
(Continued)

(52) U.S. Cl.
CPC ..... *H01R 13/6666* (2013.01); *H01R 13/506* (2013.01); *H01R 13/514* (2013.01);
(Continued)

(58) Field of Classification Search
CPC .... H01R 13/66; H01R 13/514; H01R 13/518; H01T 4/06
See application file for complete search history.

(56) References Cited

U.S. PATENT DOCUMENTS 4,741,711 A * 5/1988 Singer, Jr. ..... H04M 3/18 439/620.26
4,922,374 A * 5/1990 Mueller ..... H01R 9/2441 361/111
(Continued)

FOREIGN PATENT DOCUMENTS

CN 101595617 A 12/2009
CN 203466363 U 3/2014
(Continued)

OTHER PUBLICATIONS

International Preliminary Report on Patentability, dated Mar. 12, 2019, for International Application No. PCT/DE2017/100730, 8 pages.
(Continued)

*Primary Examiner* — Tho D Ta
(74) *Attorney, Agent, or Firm* — Seed IP Law Group LLP; Jared M. Barrett

(57) ABSTRACT

A connector module for a modular plug connector is provided having an overvoltage protection with at least one earth connection. A connector and a modular plug connector having a connector module of the above type is also provided.

10 Claims, 6 Drawing Sheets

(51) Int. Cl.
*H01R 13/514* (2006.01)
*H01R 13/518* (2006.01)
*H01T 4/06* (2006.01)

(52) U.S. Cl.
CPC ..... *H01R 13/518* (2013.01); *H01R 13/66* (2013.01); *H01R 13/6658* (2013.01); *H01T 4/06* (2013.01)

(56) References Cited

U.S. PATENT DOCUMENTS

| | | | | |
|---|---|---|---|---|
| 5,788,521 | A | 8/1998 | Milan | |
| 6,004,162 | A | 12/1999 | Harting et al. | |
| 6,243,250 | B1 | 6/2001 | Cater | |
| 6,375,496 | B1 * | 4/2002 | Casey | H01R 13/648 439/540.1 |
| 7,322,842 | B2 * | 1/2008 | Duck | G02B 6/381 200/51.03 |
| 8,064,182 | B2 * | 11/2011 | Baker | H01T 4/06 361/120 |
| 2003/0194914 | A1 | 10/2003 | Duck et al. | |
| 2007/0222302 | A1 * | 9/2007 | Leifer | H05K 1/141 310/11 |
| 2008/0318479 | A1 * | 12/2008 | Perrier | H05K 1/144 439/620.22 |
| 2010/0248508 | A1 | 9/2010 | Neumetzler | |
| 2011/0028050 | A1 | 2/2011 | Stromiedel | |
| 2011/0217880 | A1 | 9/2011 | Schmidt et al. | |
| 2012/0244754 | A1 | 9/2012 | Riepe et al. | |
| 2012/0315782 | A1 | 12/2012 | Herberchtsmeier et al. | |
| 2013/0075149 | A1 | 3/2013 | Golko et al. | |
| 2015/0199603 | A1 | 7/2015 | Troeger et al. | |
| 2016/0011376 | A1 | 1/2016 | Drescher et al. | |
| 2016/0093980 | A1 | 3/2016 | Beischer et al. | |
| 2016/0276778 | A1 | 9/2016 | Beischer et al. | |
| 2016/0285194 | A1 | 9/2016 | Herbrechtsmeier | |
| 2017/0279228 | A1 | 9/2017 | Nass et al. | |
| 2018/0172927 | A1 | 6/2018 | Song et al. | |

FOREIGN PATENT DOCUMENTS

| | | | |
|---|---|---|---|
| CN | 104865652 | A | 8/2015 |
| DE | 31 44 580 | A1 | 5/1983 |
| DE | 296 01 998 | U1 | 5/1996 |
| DE | 197 07 120 | C1 | 6/1998 |
| DE | 198 51 473 | A1 | 5/2000 |
| DE | 299 10 179 | U1 | 12/2000 |
| DE | 202 05 787 | U1 | 8/2002 |
| DE | 203 01 240 | U1 | 5/2003 |
| DE | 202 19 875 | U1 | 5/2004 |
| DE | 20 2011 050 643 | U1 | 10/2011 |
| DE | 20 2013 103 611 | U1 | 11/2013 |
| DE | 10 2012 107 270 | A1 | 2/2014 |
| DE | 10 2012 110 907 | A1 | 5/2014 |
| DE | 10 2013 102 023 | A1 | 9/2014 |
| DE | 10 2013 106 279 | A1 | 12/2014 |
| DE | 10 2014 213 728 | A1 | 1/2016 |
| DE | 20 2016 101 579 | U1 | 6/2016 |
| EP | 0 547 532 | A1 | 6/1993 |
| EP | 1 538 717 | A1 | 6/2005 |
| JP | 4605986 | B2 | 1/2011 |
| KR | 2001-0099732 | A | 11/2001 |
| RU | 2 528 171 | C2 | 2/2012 |
| RU | 2 544 839 | C2 | 7/2014 |
| WO | 2009/065470 | A1 | 5/2009 |
| WO | 2011/069521 | A1 | 6/2011 |
| WO | 2011/069522 | A1 | 6/2011 |
| WO | 2011/100942 | A1 | 8/2011 |
| WO | 2015/085995 | A1 | 6/2015 |
| WO | 2016/055055 | A1 | 4/2016 |

OTHER PUBLICATIONS

Chinese Office Action for patent application No. 201780055743.0, dated Jan. 14, 2020, 9 pages.

Russian Office Action for patent application No. 2019110274/07(019786), dated Nov. 12, 2019, 9 pages.

German Office Action, dated Jul. 14, 2017, for German Application No. 10 2016 116 926.9, 7 pages.

International Search Report and Written Opinion, dated Nov. 7, 2017, for International Application No. PCT/DE2017/100730, 13 pages. (with English Translation of Search Report).

Korean Office Action, dated Jul. 23, 2020, for Korean application No. 10-2019-7009694, 14 pages. (with English translation).

* cited by examiner

OVERVOLTAGE PROTECTION MODULE FOR A MODULAR PLUG CONNECTOR

BACKGROUND

Technical Field

The present disclosure relates to a plug module for a modular plug connector.

Modular plug connectors are used in a very wide range of technical applications. Modular plug connectors are based on the technical principle of passing on multiple different signals or currents/flows, for example electrical currents and/or fluid flows and/or light and/or data flows, via multiple plug modules and mating plug modules which are connected to each other when a plug and a mating plug of the modular plug connector are connected. In each case one plug module and one mating plug module form a plug module pair via which a specific desired signal, for example an electrical signal and/or a desired current or a desired fluid flow or a desired light or a desired light flow, which is for example a light flow for optoelectronic data transfer, and/or any kind of data flow can be passed on.

By virtue of the modular principle, these different signals and/or currents/flows can be passed on using a connecting process which can be performed simply and practically. A typical use case for a modular plug connector relates to the supplying of a piece of equipment with different signals, and at least the supplying of in particular electrical energy at different voltages and/or current strengths, and signals, for example from an equipment control unit remote from the piece of equipment.

DESCRIPTION OF THE RELATED ART

An example of a modular plug connector is known from EP 1 353 412 A2. Modular plug connectors and plug connector modular systems have also been disclosed, for example, in numerous other documents and publications, have been displayed at trade fairs, and are used in particular in industry. They are described, for example, in publications DE 10 2013 106 279 A1, DE 10 2012 110 907 A1, DE 10 2012 107 270 A1, DE 20 2013 103 611 U1, EP 2 510 590 A1, EP 2 510 589 A1, DE 20 2011 050 643 U1, EP 0 860 906 A2, DE 296 01 998 U1, EP 1 353 412 A2.

Other modular plug connectors and plug modules are known from DE 10 2013 102 023 A1 and WO 2011/100942 A1.

A retaining frame for a plug connector, having good thermal resistance and a high degree of mechanical robustness, is known from the document WO 2015/085995 A1 which, when installed in a metal plug connector housing, enables protective grounding but at the same time also ensures comfortable operability, in particular when replacing individual modules. For this purpose, it is proposed to manufacture the retaining frame at least partially from resilient sheet metal. For this purpose, the retaining frame can have a basic section and a deforming section which are formed from different materials. The basic section serves to fix a held module in a plane. The deforming section can assume an insertion state and a retaining state, wherein the insertion state permits the insertion of at least one module in a direction transverse to the plane into the retaining frame, wherein a held module is fixed in the retaining state.

The document DE 10 2014 213 728 A1 discloses a terminal block system with an overvoltage protection for a plurality of essentially identical terminal blocks situated next to one another which are arranged on a DIN rail (top hat rail).

However, it has been shown from the prior art that a complete switch cabinet which has a top hat rail to which a corresponding overvoltage protection module can be attached and hence integrated in the switch cabinet is not always available for retrofitting electrical appliances with one or more overprotection modules. It is nevertheless often necessary to subsequently fit an electrical appliance, which is or needs to be connected to a signal source and/or sink, to a network and/or a current supply, with a corresponding overvoltage protection. It has moreover been shown in the prior art to be expedient also to provide corresponding differently dimensioned overprotection circuits.

BRIEF SUMMARY

Embodiments of the present invention provide an electrical appliance with separate overvoltage protection with the least possible amount of mounting, cabling, and space.

A plug module according to an embodiment of the invention for a modular plug connector is characterized in that the plug module has electric overvoltage protection.

By way of the plug module having the overvoltage protection module, the functionality of an overvoltage protection module can advantageously be shifted to a modular plug connector which has at least one such plug module. In this way, the complexity of subsequently fitting an electrical appliance with such a modular plug connector can moreover advantageously also be significantly reduced. It is particularly advantageous that in this way individual electrical appliances can be retrofitted, separately from one another, in each case with independent overvoltage protection which is arranged in particular in the associated mounting housing specifically adapted for each individual appliance. This adaptation can relate, for example, to the reaction time and/or the threshold voltage at which overvoltage protection is triggered.

By virtue of embodiments of the invention, on the one hand it is thus possible to avoid having to install conventional known overvoltage protection subsequently in an electrical appliance which needs to be protected, which would mean engaging with the corresponding appliance, with the associated difficulties such as, for example, lack of space and the possible need to renew certificates.

Moreover, by virtue of embodiments of the invention, it is also no longer necessary for the overvoltage protection to be mounted, for example, on strips or top hat rails in a switch cabinet, where it takes up particularly valuable installation and cabling space in the switch cabinet which could also be used for other components.

Moreover, by virtue of embodiments of the invention, mistakes can also be excluded when associating multiple, possibly different, overvoltage protection modules with the individual electrical appliances of a system because, after the appropriate overvoltage protection has been integrated once in the mounting housing of the respective electrical appliance and cabled thereto, it can be considered to be rigidly connected thereto. This facilitates intuitive association during installation and protects the corresponding appliance from use of overvoltage protection which may be less suitable.

Alternatively, if flexible association is desired, an overvoltage protection module according to embodiments of the invention can also be integrated in the respective mating plug which can correspondingly be designated and associated for this purpose. This alternative embodiment is suitable, for example, for overvoltage protection modules which are specified for specific appliances, functions, and/or positions in the network.

As before, when desired, embodiments of the invention also enables the overvoltage protection module to be arranged in the switch cabinet, i.e., in the respective mounting housing of the switch cabinet or in the mating plug housing connected or provided for connection thereto, wherein the disadvantage nevertheless remains that valuable space on the top hat rail and in the cabling space in the switch cabinet is saved and the overvoltage protection can also be shifted from outside simply by replugging the mating plug using only a small amount of manual effort. It is here particularly advantageous that the plug module according to embodiments of the invention, which is an overvoltage protection module, both ensures particularly good space savings and can also be used in a particularly flexible fashion.

By virtue of embodiments of the invention, electrical appliances which need to be protected, and which are operated in a context which is particularly dangerous because of overvoltage as a result, for example, of a lightning strike and/or switching on and/or any so-called "dirty grid" and/or in particular a corresponding predetermined grounding situation, can be protected separately from one another and in particular according to their electronic structural form and/or their grounding-specific arrangement in the grid in each case by independent overvoltage protection with particularly suitable dimensions.

Overvoltage protection is known in principle to a person skilled in the art. As a rule, voltage peaks are conducted away by overvoltage protection circuits provided for this purpose by gas arresters and diodes to the ground of the respective electrical appliance, i.e., are connected to the grounding contact of the corresponding appliance in an electrically conductive fashion. The components are expediently thus interconnected and dimensioned such that the voltage peaks can at least not damage any electrical hardware of the connected electrical appliance.

The plug according to an embodiment of the invention for a modular plug connector has a plurality of plug modules, at least one of which is configured as the overvoltage protection module according to an embodiment of the invention. As already indicated above, a modular plug connector having a mounting housing and a mating plug can, for example, be obtained by which the complexity of installing an overvoltage protection module and the associated cabling complexity can be significantly reduced, and moreover space, in particular structural space and/or cabling space for example in switch cabinets or control cabinets or in the corresponding electrical appliance, can be saved.

In a practical embodiment, the plug has at least one retaining frame in which the plug modules are held or retained. However, the retaining frame can also be mounted or attached or fastened on a surface such as, for example, on a surface of the electrical appliance in order to attach the plug of the modular plug connector together with the plug modules on the surface. The plug modules are preferably held detachably in the retaining frame and in particular are held rigidly and detachably.

The plug modules are particularly preferably held positively and/or frictionally in the retaining frame. Positive holding can be achieved in particular by a plurality of latching lugs, provided on each plug module, which can each be accommodated in latching windows which are provided on side parts of the retaining frame.

In a particularly practical embodiment, the retaining frame can be held or mounted in the plug connector housing, in particular the mounting housing. The plug connector housing, in particular the mounting housing, can be attached to a surface, for example of a switch cabinet or equipment cabinet, or also particularly advantageously on a surface of the electrical appliance to be protected.

The retaining frame can particularly preferably be held positively and/or frictionally in the plug connector housing. The retaining frame can be held rigidly and securely in the plug connector housing in particular by positive and frictional holding.

The retaining frame can in particular have two side parts connected to each other in an articulated fashion. The side parts can then, by the retaining frame being screwed into the plug connector housing or onto another surface, automatically be oriented parallel with each other and consequently fix the plug modules in their position. However, it is also conceivable that the retaining frame parts are moved together via a translational movement, or that the retaining frame which has a basic frame with an essentially rectangular cross-section has, for example on cheek parts attached to said basic frame, resilient brackets with latching windows into which plug modules are usually inserted in the plugging-in direction and are then retained in the retaining frame, perpendicularly thereto, and additionally are fixed in the plugging-in direction by them latching with their latching lugs in the latching windows. Such a retaining frame can in particular be manufactured from an electrically conductive material, in particular metal, in order to permit the necessary grounding via a grounding screw and/or via the electric contact with the plug connector housing. The cheek parts can then be made, for example, of resilient sheet metal. The overvoltage protection module can have a grounding spring which electrically conductively connects a ground connection of its overvoltage protection circuit, which in particular is arranged, together with this ground connection, on a printed circuit board, to the retaining frame, either directly on its side parts or possibly also via the resilient cheek parts with are fastened electrically conductively therein or thereon, in particular adhesively bonded, welded, soldered, riveted, snap-fitted, or screwed. In particular, electrical contacting with the cheek parts lends itself to this case when the cheek parts, which are formed in particular from resilient sheet metal, are bent for example by 180° and are thus preferably fastened to the basic frame from inside, wherein the appropriate fastening method for the cheek parts to the basic frame should be chosen according to the optimum electrical conductivity. In particular, welding, soldering, riveting, snap-fitting, and/or screwing the resilient cheek parts to the basic frame lends itself for this in order to ensure particularly good electrical conductivity between the cheek parts and the basic frame.

The modular plug connector according to embodiments of the invention has a retaining frame, preferably with a plurality of plug modules and in particular a mounting housing and a mating plug with a plurality of mating plug modules, wherein in each case a plug module of the plug and a mating plug module of the mating plug form a plug module pair, wherein the plug and the mating plug can assume a state in which they are connected to each other and in which the plug module and the mating plug module of each plug module pair are connected to each other, i.e., are plugged together and in particular are locked together, for example by a locking bracket, that however they can also assume a state in which they are separated from each other and in which the plug module and the mating plug module of each plug module pair are detached from each other, wherein, in the case of the plug module pair or pairs with the plug module according to embodiments of the invention in the connected state of the plug and mating plug, at least one plug module pair contains at least one overvoltage protection module.

BRIEF DESCRIPTION OF THE SEVERAL VIEWS OF THE DRAWINGS

An exemplary embodiment of the invention is shown in the drawings and explained in detail below. In the drawings.

The drawings contain partially simplified schematic views. Identical reference numerals are used partly for identical, but possibly non-identical elements. Different views of the same elements could be at a different scale.

DETAILED DESCRIPTION

Figure 1:
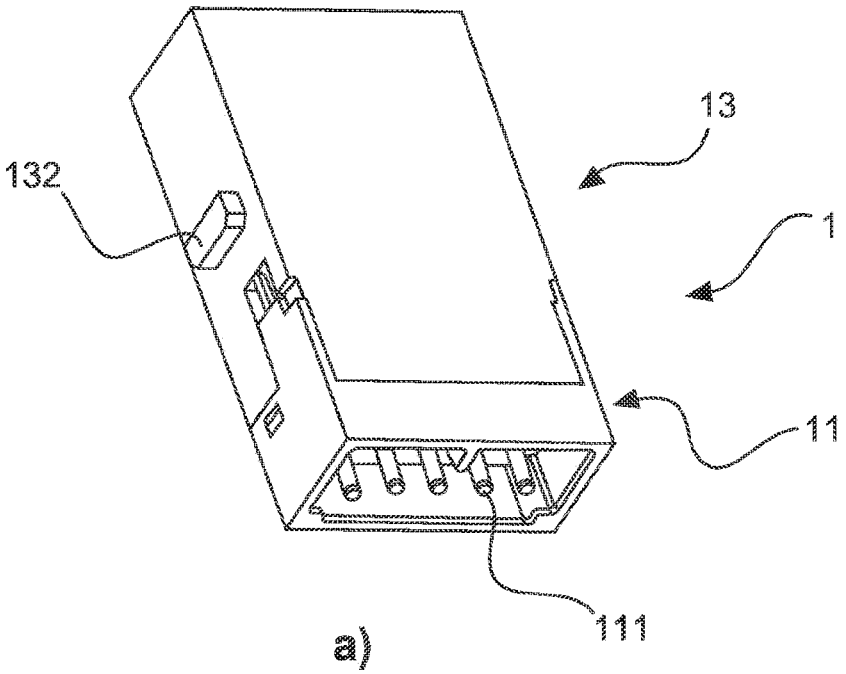
FIGS. 1*a, b* show a plug module and a mating plug module.
Figure 1:
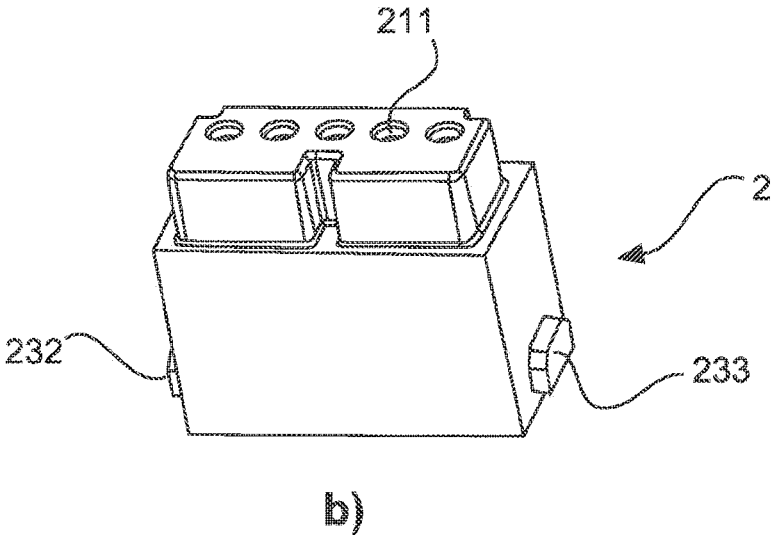

FIG. 1*a* shows a plug module 1 and FIG. 1*b* shows a mating plug module 2 which can be plugged thereto. The plug module 1 has an overvoltage protection circuit such that the plug module 1 is an overvoltage protection module. This overvoltage circuit is covered in this view by a module housing. The module housing is made from an electrically insulating material, for example plastic, and is formed from a first housing part 11 and a second housing part 13 joined together therewith. The second housing part 13 has two large latching lugs 132, 133, with different independent polarities, which are integrally formed on two opposite narrow side parts of the second housing part 13 and only the first one 132 of which can be seen in FIG. 1*a*. Moreover, pin contacts 111 are pressed into the first housing part 11 and thus form a plug face of the plug module 1. In an alternative embodiment not shown in the drawings, the plug module 1 has socket contacts.

The mating plug module 2 shown in FIG. 1*b* has a corresponding plug face with socket contacts 211. In the abovementioned alternative embodiment not shown in the drawings, the mating plug module has pin contacts. Two such latching lugs 232, 233 are likewise integrally formed on the housing of the mating plug module 2.

The two plug faces furthermore also have plug-side polarization means (not described in detail) in the form of polarizing tabs and recesses/slots.

Figure 2:
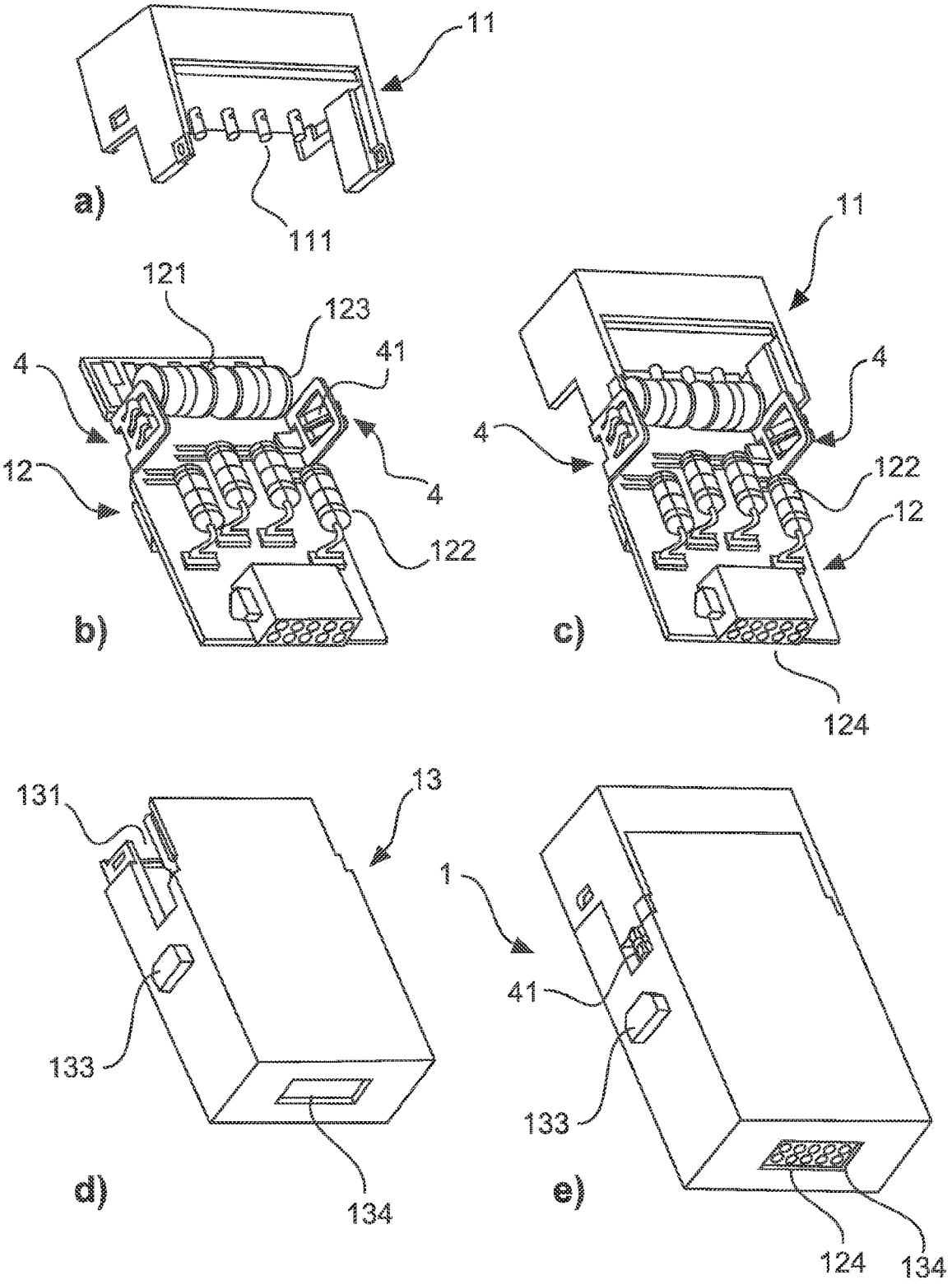
FIGS. 2*a-e* show the plug module in an exploded view and in the assembled state.
Figure 4:
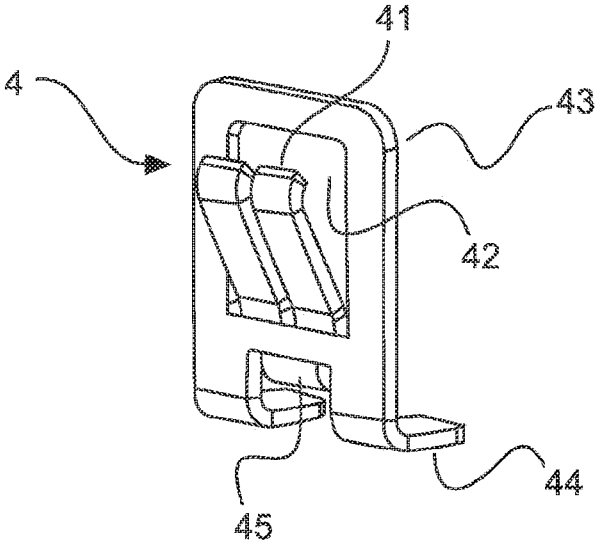
FIG. 4 shows the grounding spring in a separate view.

FIG. 2 shows the plug module 1 in an exploded view. FIG. 2*a* shows the first housing half and the pin contacts 111 from their connection side. A rectangular printed circuit board 12 with the overvoltage protection circuit, constructed from diodes 122 and gas arresters 123, can be clearly seen in FIG. 2*b*. For connection to the connection side of the pin contacts 111, the printed circuit board has corresponding connection pads 121, on one of its narrow sides, which are connected electrically conductively to the protective circuit via strip conductors. Two grounding springs 4, which are also shown as a separate component in FIG. 4, are situated opposite each other and each is connected to a ground connection of the printed circuit board 12.

The printed circuit board 12 with its connection pads 121 is soldered to the pin contacts 111 in FIG. 2*c*. On its opposite narrow side, the printed circuit board 12 has a cable connection element 124, the connections of which are connected electrically conductively via further strip conductors to the overvoltage protection circuit, namely to a connection of the diodes 122.

FIG. 2*d* shows the second housing part 13, wherein the second 133 of the two latching lugs 132, 133 can be seen in this view. On the cable connection side, the second housing part 13 has a connection window 134. At its opposite opening, which is provided for insertion of the printed circuit board 12 into the second housing part 13, or in other words for plugging the second housing part 13 onto the printed circuit board 12, the second housing part 13 has, on both sides on two opposite side parts, in each case a slot-like opening 131 and moreover a latching mechanism not described in detail for fastening it on the first housing part 11. In the plugged-together, i.e., mounted state which is shown in FIG. 2*e*, a window opening remains at least in the end region of the slot-like opening 131. In the mounted state, the window opening thus formed also allows parts of the contact spring 4 to project in order to contact the ground.

Figure 3:
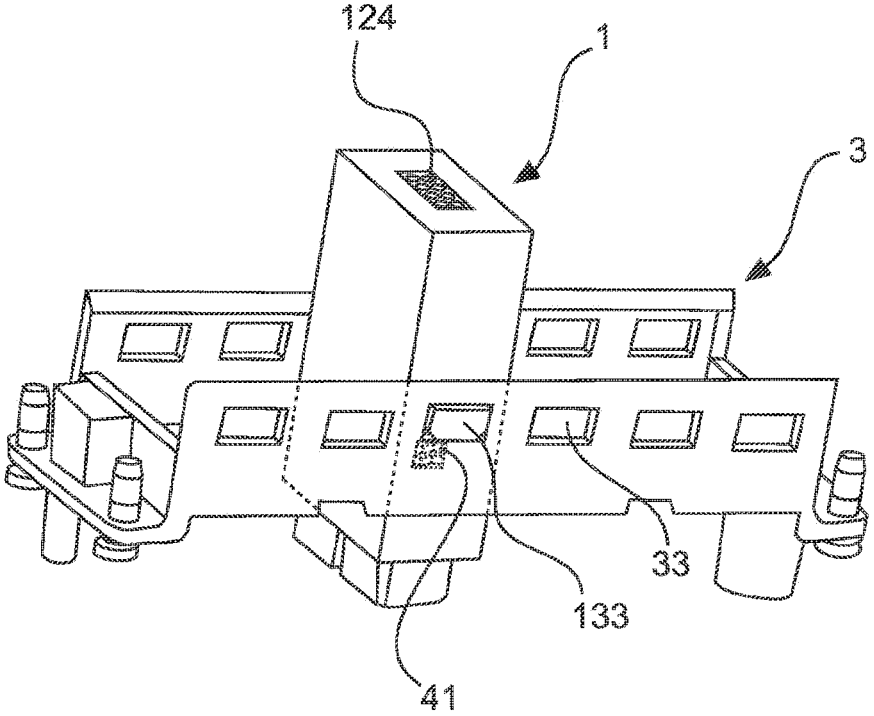
FIG. 3 shows the plug module, inserted in a retaining frame, with a grounding spring.

Contacting the ground when the plug module 1 is held with a metal retaining frame 3 is shown in FIG. 3. The latching lugs 132, 133 of the plug module 1 are held in latching windows 33 of the retaining frame 3, as a result of which the plug module 1 is fixed in the retaining frame 3.

The contact spring 4 of the plug module with its two spring arms 41 is shown in dashed lines inside the retaining frame 3, wherein the contact spring 4 electrically contacts the retaining frame 3 with its spring arms 41. This makes it possible to conduct away an electrical overvoltage through the overvoltage protection circuit via the retaining frame 3 and hence possibly also to a plug connector housing 5 shown in FIG. 7.

FIG. 4 shows the contact spring 4. It is a stamped and bent part made from resilient sheet metal which is essentially rectangular in shape in its unbent state. In a part region, a window 42 is stamped therefrom on three sides, parallel to three outer sides, such that a three-sided rectangular frame 43 is formed on these three sides, and a resilient tab is formed on the fourth side. Dividing this tab into two halves creates two parallel spring arms 41, each standing free on three sides, which at their base are bent out from the plane of the window 42 in a first direction and, toward their ends, are bent back slightly in the opposite direction toward the frame 43 of the contact spring 4.

A second part region has two parallel slots extending in the direction of the window 42, by which three parallel tabs are first formed. The two outer tabs are then bent at a first bending edge at right angles and in an opposite direction to the first direction, as a result of which fastening feet 44 bent at right angles are formed. The inner tab is bent at a second bending edge in the same direction, as a result of which a right-angled soldering tag 45 is formed at a different distance from the window 42, wherein the first bending edge is further away from the window 42 than the second bending edge by the thickness of the printed circuit board 12. The contact spring can thus be clamped laterally to the printed circuit board 12, on the one hand with its fastening feet for example "below" the printed circuit board 12 and, on the other hand, with its soldering tag 45 for example "above" the printed circuit board 12, as a result of which retention is readily ensured. The soldering tag 45 can then be soldered to the respective ground contact of the printed circuit board 12 for ground contacting the contact spring 4, as a result of which fastening of the contact spring 4 on the printed circuit board 12 is also strengthened.

Figure 5:
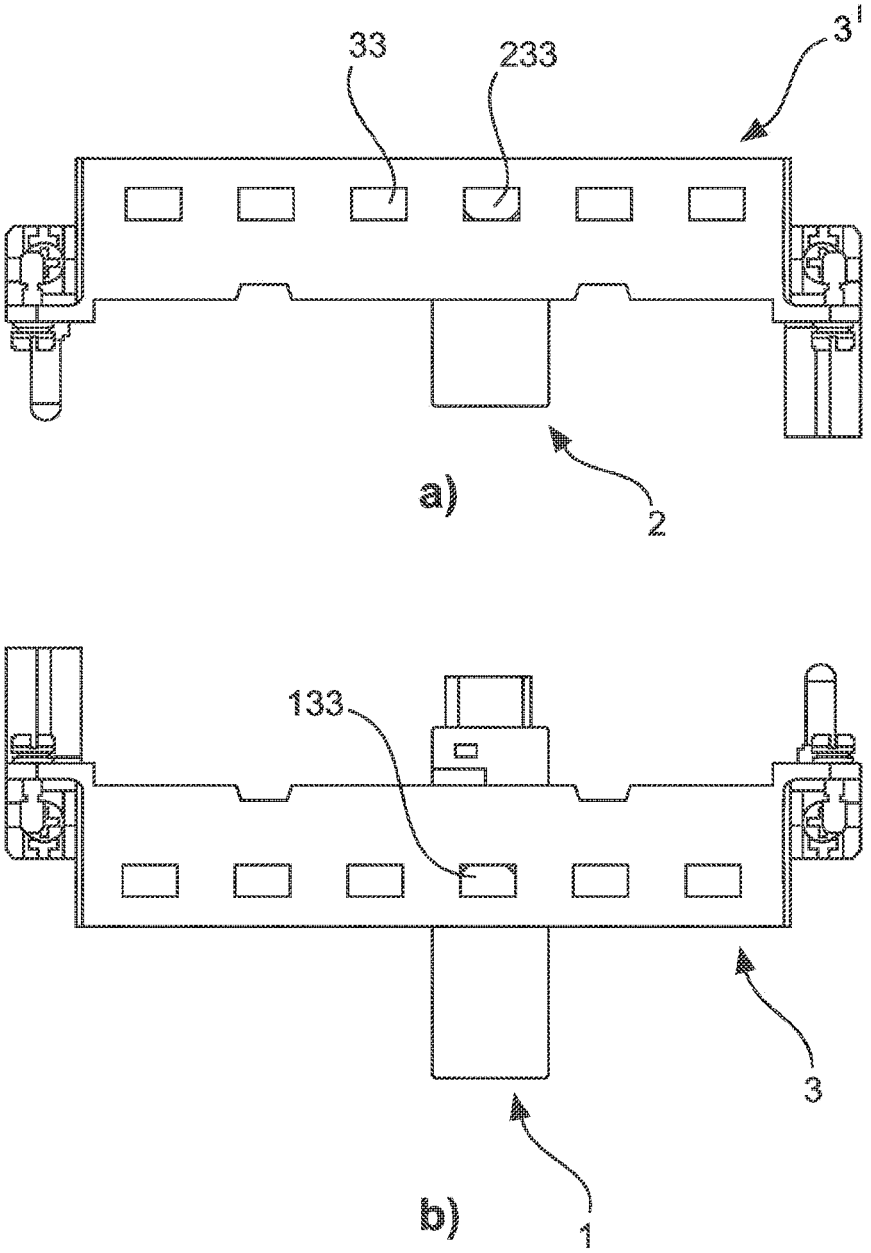
FIGS. 5*a, b* show the plug module and the mating plug module, which are each inserted in a retaining frame, in a side view.

FIG. 5 shows two identical retaining frames 3, 3' in a side view. The first retaining frame 3 is equipped with a plug module 1. The second retaining frame 3' is equipped with a mating plug module 2. The two retaining frames 3, 3' and the two modules 1, 2 are each suited for being mutually plugged together.

Figure 6:
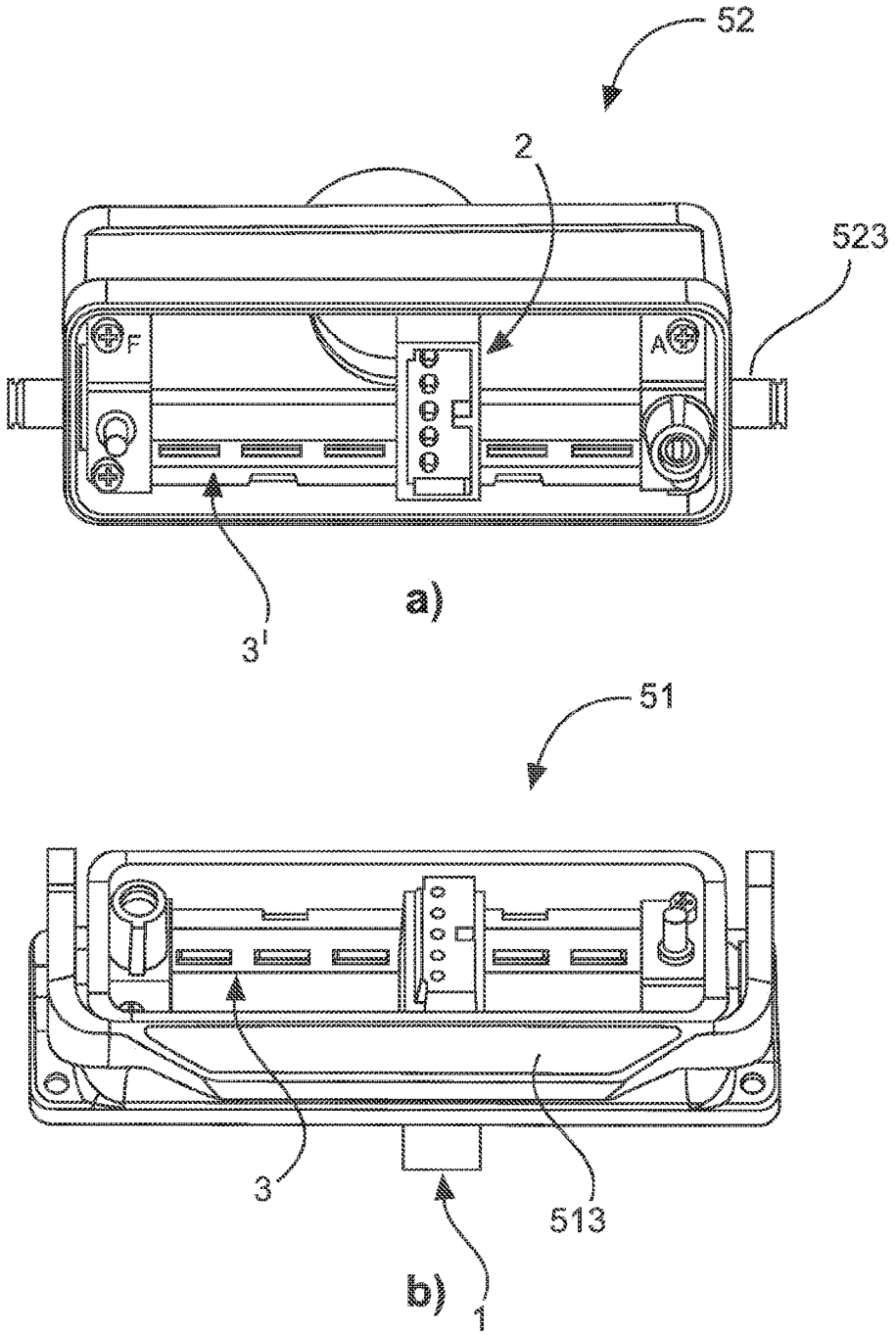
FIGS. 6*a, b* show a mounting housing and mating plug housing with the retaining frame installed therein, in oblique views.

FIG. 6 shows a plug with a mounting housing 51 and a mating plug with a mating plug housing 52. The retaining frame 3 with the plug module 1 is installed in the mounting housing 51. The second retaining frame 3' with the mating plug module 2 is installed in the mating plug housing 52. The mounting housing 51 has a locking bracket 513. The mating plug housing 52 has locking lugs 523 which are provided to interact with the locking bracket 513. The mating plug housing 52 can thus be plugged and locked to the mounting housing 51.

Figure 7:
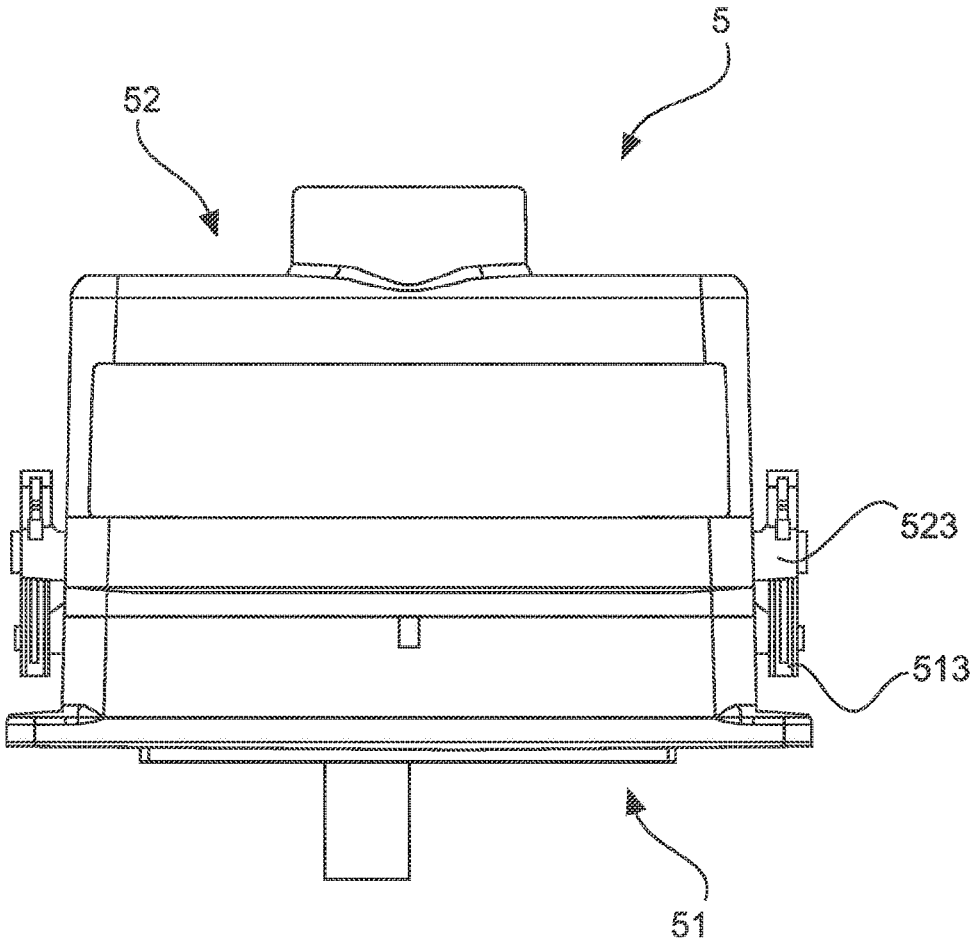
FIG. 7 shows a plug connector, with the mounting housing and the mating plug housing plugged and locked thereto, in a side view.

FIG. 7 shows the plug connector with its plug connector housing 5 in the plugged and locked state.

Even when different aspects or features of the invention are shown in each case in combination in the drawings, unless otherwise stated it is apparent to a person skilled in the art that the combinations shown and discussed are not the only possible ones. In particular, corresponding units or groups of features from different exemplary embodiments can be exchanged with one another.

In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A plug module of a modular plug connector having a retaining frame formed from an electrically conductive material, the plug module comprising:

an overvoltage protection circuit arranged on a printed circuit board such that the plug module is an overvoltage protection module;

a module housing made from an electrically insulating material which encloses the printed circuit board, the module housing having a window opening in a lateral side that faces the retaining frame when the plug module is received therein; and at least one contact spring which is connected electrically conductively to a ground connection of the overvoltage protection circuit for conducting away overvoltages, the at least one contact spring including one or more contact arms that project outwardly through the window opening of the module housing and contact the retaining frame when the plug module is received therein.

2. The plug module as claimed in claim 1, wherein the overvoltage protection circuit has at least one diode and at least one gas arrester and is arranged on the printed circuit board.

3. A plug for a modular plug connector, wherein the plug is suitable for accommodating a plurality of plug modules and has at least one plug module as claimed in claim 1.

4. A modular plug connector, wherein the modular plug connector has a plug as claimed in claim 3 and a mating plug with a plurality of mating plug modules, wherein in each case a plug module of the plug and a mating plug module of the mating plug form a plug module pair, wherein the plug and the mating plug can assume a state in which they are connected to each other and in which the plug module and the mating plug module of each plug module pair are connected to each other and can assume a state in which they are separated from each other and in which the plug module and the mating plug module of each plug module pair are detached from each other, wherein in the case of the plug module pair with the overvoltage protection module, in the connected state of the plug and mating plug, the overvoltage protection module establishes an electrically conductive plugged connection and is connected to an electrical device to be protected against overvoltage.

5. The plug as claimed in claim 3, wherein the plug comprises the retaining frame in which the plug modules are held.

6. The plug as claimed in claim 5, wherein the plug modules are held positively or frictionally in the retaining frame.

7. The plug as claimed in claim 5, wherein the plug has a metal plug connector housing, wherein the retaining frame can be held in the plug connector housing.

8. The plug as claimed in claim 7, wherein the retaining frame can be held positively and/or frictionally in the plug connector housing and consequently can be electrically contacted therewith.

9. The plug as claimed in claim 7, wherein the plug connector housing consists of a mounting housing and a mating plug housing, and wherein the retaining frame with the plug module can be held positively and/or frictionally in the mounting housing.

10. A plug for a modular plug connector, wherein then plug comprises a retaining frame formed from an electrically conductive material which is suitable for accommodating a plurality of plug modules and has at least one plug module configured as an overvoltage protection module, wherein the overvoltage protection module has a printed circuit board, and wherein the overvoltage protection circuit is arranged on the printed circuit board, wherein the overvoltage protection module has at least one contact spring for conducting away overvoltages, and wherein the printed circuit board has at least one ground connection which is connected electrically conductively to the contact spring as a component of the overvoltage protection circuit, wherein the overvoltage protection module has a module housing, made from an electrically insulating material, which encloses the printed circuit board in the mounted state, wherein in the mounted state the module housing has at least one window opening in a lateral side thereof facing the retaining frame through which one or more contact arms of the at least one contact spring project for contacting the retaining frame, and wherein the one or more contact arms of the contact spring automatically electrically contact the retaining frame by virtue of the overvoltage protection module being held in the retaining frame.

* * * * *